US007158646B2

(12) United States Patent
Bank et al.

(10) Patent No.: US 7,158,646 B2
(45) **Date of Patent: *Jan. 2, 2007**

(54) SIGNAL DERIVED BIAS SUPPLY FOR ELECTROSTATIC LOUDSPEAKERS

(75) Inventors: Jeevan G. Bank, San Diego, CA (US); James J. Croft, III, Poway, CA (US)

(73) Assignee: American Technology Corporation, San Diego, CA (US)

( * ) Notice: Subject to any disclaimer, the term of this patent is extended or adjusted under 35 U.S.C. 154(b) by 385 days.

This patent is subject to a terminal disclaimer.

(21) Appl. No.: 10/673,010

(22) Filed: Sep. 26, 2003

(65) Prior Publication Data

US 2004/0066942 A1 Apr. 8, 2004

Related U.S. Application Data

(63) Continuation of application No. 09/430,078, filed on Oct. 29, 1999, now Pat. No. 6,628,791.

(51) Int. Cl.
*H04R 3/00* (2006.01)

(52) U.S. Cl. ..... 381/113; 381/191; 381/120; 330/199

(58) Field of Classification Search ..... 381/111, 381/113, 120, 191; 330/199
See application file for complete search history.

(56) References Cited

U.S. PATENT DOCUMENTS

| | | | | |
|---|---|---|---|---|
| 2,896,025 | A | 7/1959 | Janszen | |
| 3,632,903 | A * | 1/1972 | Lange, Jr. | 381/309 |
| 3,895,193 | A * | 7/1975 | Bobb | 381/116 |
| 3,992,585 | A | 11/1976 | Turner et al. | |
| 4,160,882 | A | 7/1979 | Driver | |
| 4,207,442 | A * | 6/1980 | Freeman | 381/116 |
| 5,392,358 | A | 2/1995 | Driver | |
| 5,471,540 | A * | 11/1995 | Maeda | 381/191 |
| 6,628,791 | B1 * | 9/2003 | Bank et al. | 381/113 |

* cited by examiner

*Primary Examiner*—Brian T. Pendleton
(74) *Attorney, Agent, or Firm*—Thorpe North & Western LLP

(57) ABSTRACT

An electrostatic loudspeaker requires a high voltage DC bias power supply to bias the stators and diaphragms of electrostatic speakers. A self biased power supply eliminates the need for an external power supply by deriving a high voltage bias from the stator AC signal voltages which have been rectified and run from a high voltage tap and/or through a voltage multiplier which has a voltage limiting means.

25 Claims, 8 Drawing Sheets

SIGNAL DERIVED BIAS SUPPLY FOR ELECTROSTATIC LOUDSPEAKERS

This application is a continuation and claims priority from non-provisional application Ser. No. 09/430,078 filed on Oct. 29, 1999 now U.S. Pat. No. 6,628,791, and entitled SIGNAL DERIVED BIAS SUPPLY FOR ELECTROSTATIC LOUDSPEAKERS.

TECHNICAL FIELD

This invention relates generally to the field of electrostatic speakers and more specifically to power supplies for biasing electrostatic speakers.

BACKGROUND ART

The long history of electrostatic speakers has produced a wide variety of speaker configurations. To provide a linear output, an electrostatic speaker requires a high (500 to 5000 volts) substantially DC (direct current) voltage to be applied either to the stators or the diaphragm. This applied voltage creates a DC constant for the AC (alternating current) signal voltages to work against. Since only the leakage currents need to be supplied, the wattage rating of the fixed bias supply can be quite low (less than a watt) and the package size can be small (a few cubic inches).

Historically, this DC voltage has been provided by running a step-up transformer from an AC power line, rectifying its output, and connecting the rectified output to a capacitor. U.S. Pat. No. 2,896,025 granted to Janszen embodies this approach. This configuration is easy to implement but can be somewhat costly. It can also be inconvenient to have to run separate AC main wires and also signal wires from the power amplifier. Additionally, if the AC power is intended to be supplied directly from a wall source, there may be no AC power sockets located nearby the electrostatic loudspeakers. Another drawback of using a separate AC power supply is that the separate power supply results in additional cost and wiring which makes electrostatic speakers a less desirable choice in most consumer applications. Thus, the electrostatic speakers are less desirable even though they offer superior performance and greater sound fidelity when they couple into the air.

In particular applications where the systems run off of DC, such as a laptop computer or a portable music system, a high voltage source of AC may not be available. In these applications, a DC to DC converter is required to produce the required high voltages. This DC to DC convertor system is illustrated in U.S. Pat. No. 3,992,585 granted to Turner, et al.

Another method to provide a DC bias, which avoids many of the issues in the prior art listed above, is to tap off of the secondary winding of the audio signal transformer. The tapped voltage is then rectified and the energy is stored in a capacitor. Because the bias currents are near zero, this approach has virtually no impact on the signal currents. Disclosures of this technique can be found in U.S. Pat. No. 3,895,193 granted to Bobb, U.S. Pat. No. 4,160,882 granted to Driver and U.S. Pat. No. 5,392,358 granted to Driver.

For most consumer applications, what would be most useful, is a "drop in" replacement for existing electromagnetic speakers. In other words, an electrostatic speaker which can effectively replace existing electromagnetic speaker systems is desirable. This would eliminate the need for an AC outlet or a DC to DC convertor and maintain a simple connection with two wires for each speaker. Self-biasing can provide this, but the prior art systems all suffer from a common group of significant drawbacks.

First, because the AC audio signal is not predictable or repeatable, the voltage available at the output of the audio signal step-up transformer can vary from a zero voltage to a voltage that can damage the electrostatic unit due to over voltage.

A second problem with the prior art type of bias system is that when the audio equipment is first powered up, the self-bias voltage (and hence the resulting electric field) is at, or close to zero. As a result, there is a start up time during which the audio level gradually increases to the maximum. During the charging period, the program signal will not be heard at its proper volume. For certain types of music and some audio material, many seconds elapse before the self-bias voltage comes into its normal range. One approach is to have a fast signal rise time when the system is turned on. To increase the signal rise time, the transformer step-up ratio can be increased but this can then make the first problem of over-voltage even worse.

A third problem is that prior art self-bias circuits provide a variable bias voltage. The side effect of the variable bias voltage can best be described as producing a noticeable "pumping action" in the reproduced acoustic output level.

A fourth problem with this type of bias system is that in a multi-channel system, each channel can end up with different bias levels at any given time. Therefore, each channel would have a different efficiency and would be mismatched depending on how well the multi-channel program material was matched from channel to channel at any given moment.

OBJECTS AND SUMMARY OF THE INVENTION

It is an object of the present invention to provide a bias system which uses a simple two wire speaker connection and the reduces cost of self-biasing for DC field generation in the electrostatic speaker.

It is also an object to provide a bias system which uses an audio signal derived bias system for an electrostatic loudspeaker that steps up the voltage to the required level even with program material at a low level, and maintains a substantially constant supply voltage.

It is another object of the current invention to provide a self bias system which uses a voltage limiting/regulating means in an output signal fed bias supply so the voltage is stabilized to be substantially constant and limited from over voltage.

It is a further object of the invention to achieve a more effective startup than prior art systems using the greater step-up ratio of the transformer secondaries.

It is an additional object of the invention to provide a more effective startup using greater multiplication stages in the voltage multiplier circuit and a separate charging signal delivered from the associated active electronics which charges on startup, periodically, or on a steady basis.

The presently preferred embodiment of the present invention is an audio signal derived bias supply for use with an electrostatic loudspeaker. The bias supply includes at least one transformer adapted to receive an audio signal. The transformer has at least one primary winding, and primary connection taps. The transformer also has at least one secondary winding magnetically coupled to the primary winding, which has at least two secondary connection taps. A bias circuit is connected to the at least one secondary winding. The bias circuit has a rectification means and a voltage limiting means, coupled to the rectification means.

These and other objects, features, advantages and alternative aspects of the present invention will become apparent to those skilled in the art from a consideration of the following detailed description taken in combination with the accompanying drawings.

DETAILED DESCRIPTION OF THE PREFERRED EMBODIMENTS

Reference will now be made to the drawings in which the various elements of the present invention will be given numerical designations and in which the invention will be discussed so as to enable one skilled in the art to make and use the invention. It is to be understood that the following description is only exemplary of certain embodiments of the present invention, and should not be viewed as narrowing the claims which follow.

Figure 1:
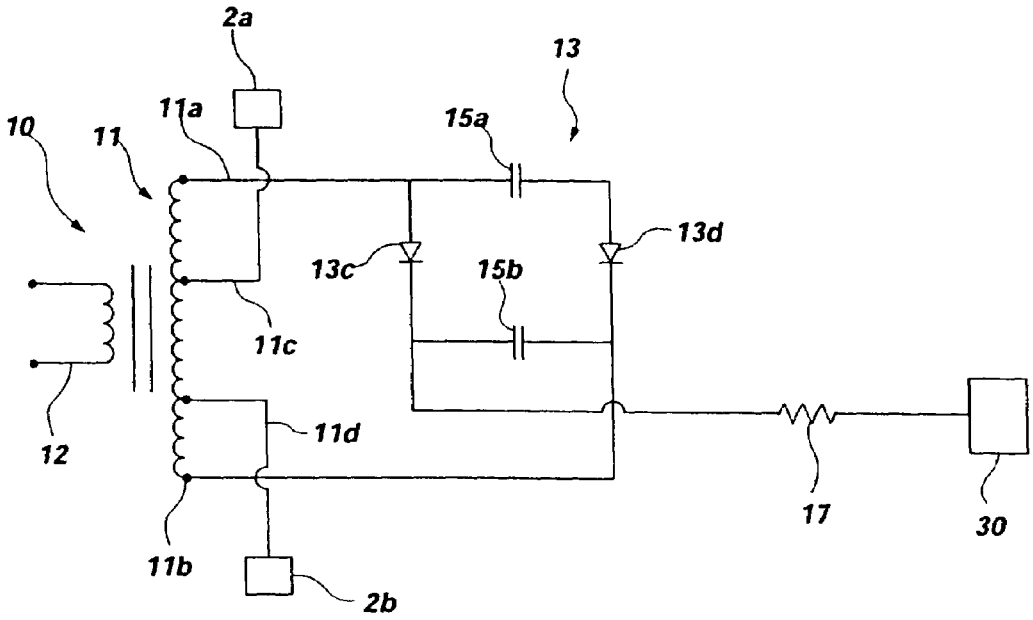
FIG. 1 (PRIOR ART)
FIG. 1 shows a prior art self bias circuit.

FIG. 1 represents a prior art self bias circuit for an electrostatic speaker. The transformer 10 accepts an input signal to a primary winding 12, which is then converted into a higher voltage and output through the secondary winding 11. Lower voltage outputs 11*c* and 11*d* send audio signals to stators 2*a* and 2*b*. Higher voltage taps 11*a* and 11*b* feed the voltage doubler 13, which consists of diodes 13*c* and 13*d*, and capacitors 15*a* and 15*b*. The unregulated, non-limited voltage signal is sent through resistor 17 to diaphragm 30. With this type of system, the voltage varies up and down due to the dynamics of the program material and provides a substantially alternating voltage to the diaphragm 30 instead of the preferred constant DC voltage. In addition, there is no limit to the voltage buildup at the speaker diaphragm 30.

Figure 2:
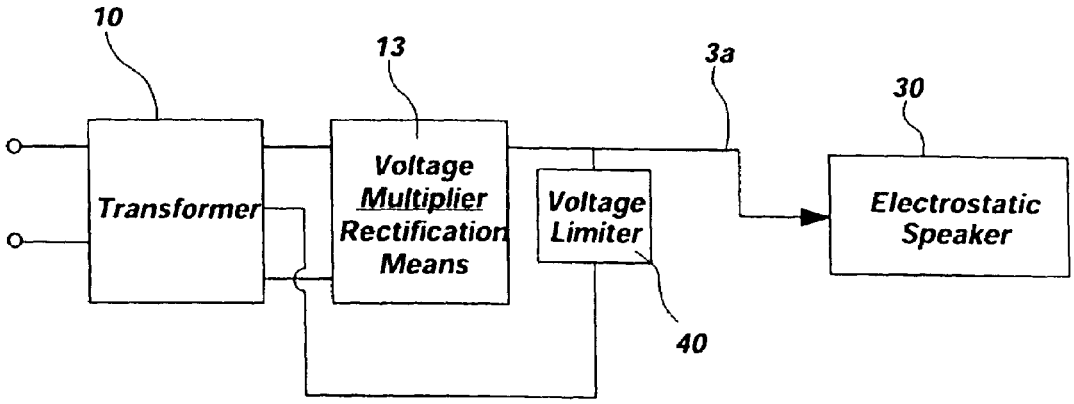
FIG. 2 shows a block diagram of the signal derived bias supply.

FIG. 2 shows a basic block diagram of the present invention. A program signal is received by the transformer 10, and output to a voltage multiplier and rectifier means 13. The voltage multiplier and rectification means 13 has a bias supply output 3*a* which is regulated and limited by the voltage limiter 40. The output voltage 3*a* is then supplied to the electrostatic diaphragm 30.

Figure 3:
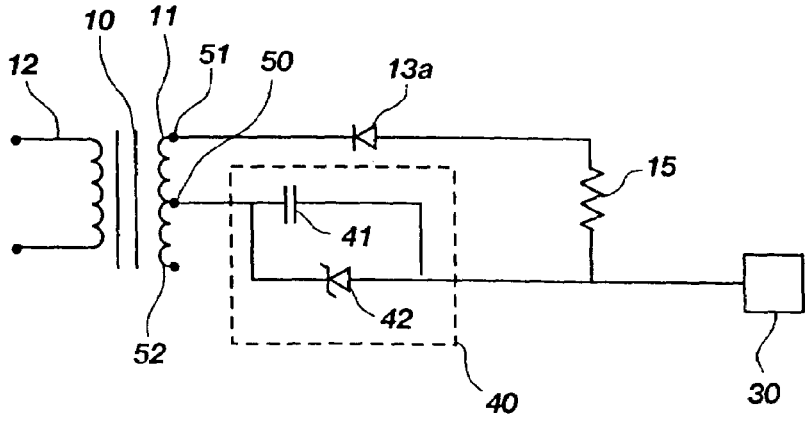
FIG. 3 shows a simple schematic diagram of the signal derived bias supply.

FIG. 3 shows a schematic of a signal derived bias power supply in its most basic operational form. A program signal is received by the primary winding 12 of a transformer 10 and output as a higher voltage from the secondary winding 11 through the tap 51. The signal is rectified by a diode 13*a* and resistively coupled through a resistor 15 to a speaker diaphragm 30 and returns to the transformer center tap 50 through a voltage limiter 40 or shunt regulator which consists of a capacitor 41 and a zener diode 42. The conventional definition of a center tap is that an approximately equal number of secondary windings are on either side of the tap. It is important to realize that this invention will work with a center tap which does not have an equal number of secondary windings on either side of the center tap. Offsetting the center tap does mean that one side of the circuit produces a higher voltage than the other which is not necessarily desirable, but it is a workable configuration. In addition, the center tap could also be a bias return with another configuration such as a voltage divider or a similar arrangement. Accordingly, as used in this application, center tap refers to a biasing tap separate from the stator taps 51.

The zener diode 42 and capacitor 41 coupled to the secondary winding in the circuit shown in FIG. 3 perform a voltage regulation function. It should be realized based on this disclosure, that other voltage limiting means could be used in place of the zener diode and capacitor to perform a regulation function and protect the electrostatic diaphragm from over voltage. For example, a controlled spark gap component, transistors, or similar equivalent devices could be used for voltage regulation, although they might require other active circuitry to perform the regulation function.

Figure 4A:
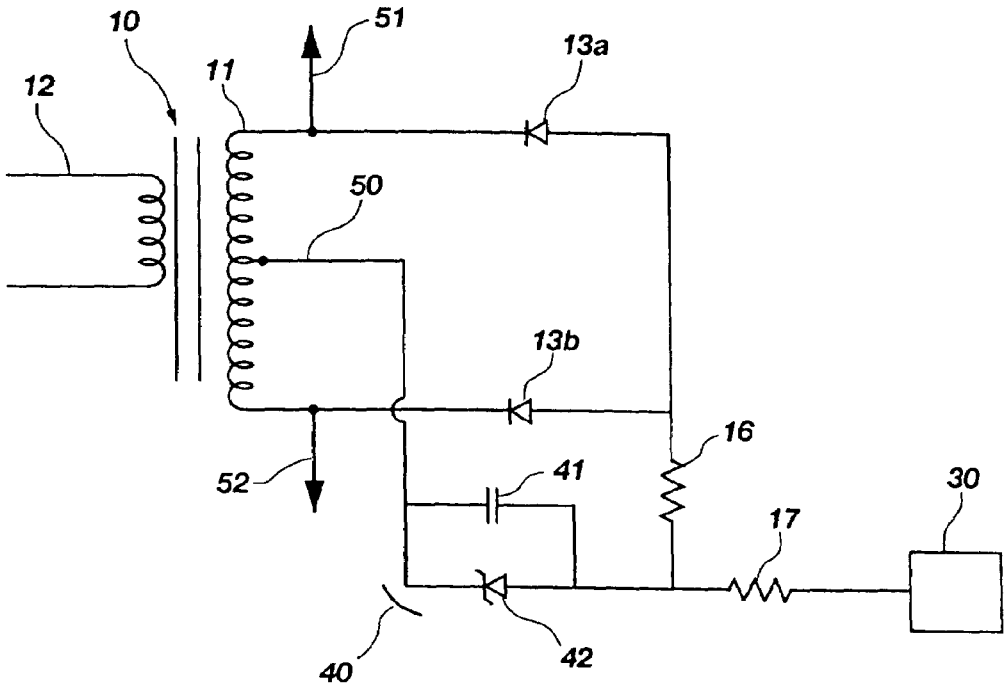
FIG. 4A shows a simple schematic diagram of another form of the self bias supply.

FIG. 4A is essentially the same as FIG. 3 with an additional diode rectifier 13*b* to allow for a symmetrical contribution from both of the secondary taps 51 and 52 of the secondary winding 11. Another important element that has been added is a resistor 17 to provide lower distortion, and constant charge operation of the speaker diaphragm 30.

Figure 4B:
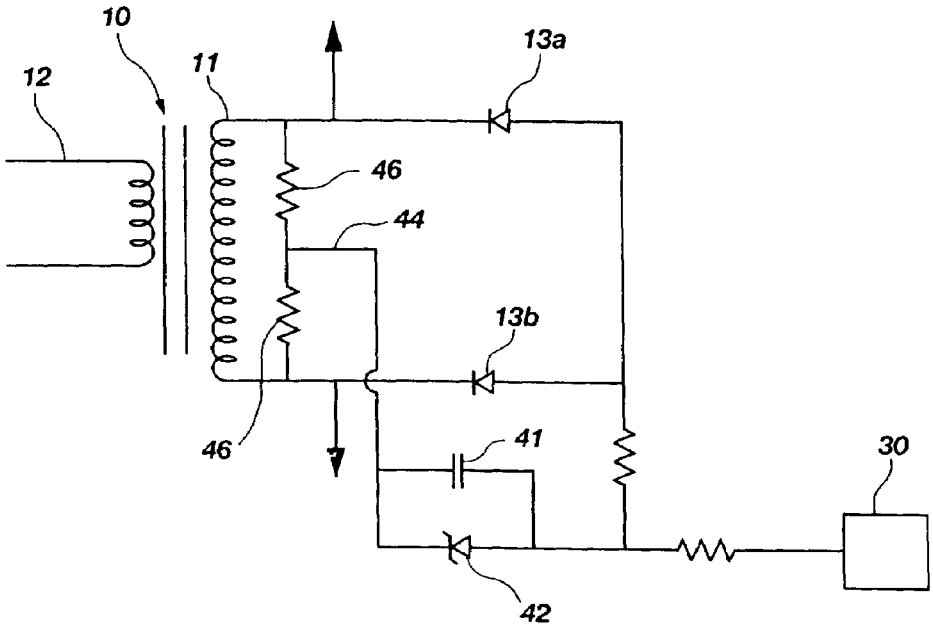
FIG. 4B shows a schematic diagram of a self bias supply using a voltage divider.

FIG. 4B shows a schematic diagram of a self bias supply using a voltage divider. The arrangement of the rectifier diodes 13*a* and 13*b* and the bias circuit with the zener diode(s) 42 and capacitor 41 are the same as in FIG. 4A. An important part of FIG. 4B is that the center tap or bias return in FIG. 4A has been synthesized using a voltage divider which is connected to the transformer 10. The primary signal 12 which enters the transformer 10 is stepped up through the secondary windings 11. Then instead of a center tap, the two resistors 46 reduce the voltage at the connection 44 to a lower voltage similar to one that would be received from a center tap.

Figure 5:
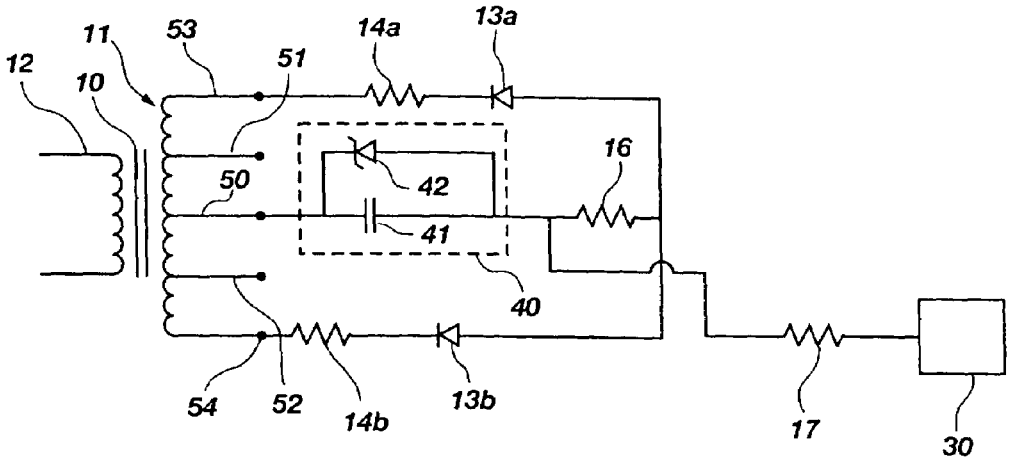
FIG. 5 shows a form of the self bias supply using a transformer with more windings.

FIG. 5 is an alternative embodiment of the functionality shown in FIG. 4A. The voltage bias supply in FIG. 5 is fed off of the high voltage secondary taps 53 and 54. Adding the resistors 14*a* and 14*b* further isolates the voltage limiter 40 from any discontinuities produced by fluctuations in the secondary winding taps 51 and 52. Although a single secondary winding with multiple taps is shown, it should be apparent based on this disclosure that many separate secondary windings could be provided and wrapped around the same transformer core. In FIG. 5, a separate winding could be used for each voltage which is desired. For example, a separate high voltage winding could be used between taps 53 and 54, and then a separate lower voltage winding could be used between taps 51 and 52. Other alternative winding arrangements could also be conceived.

Figure 6:
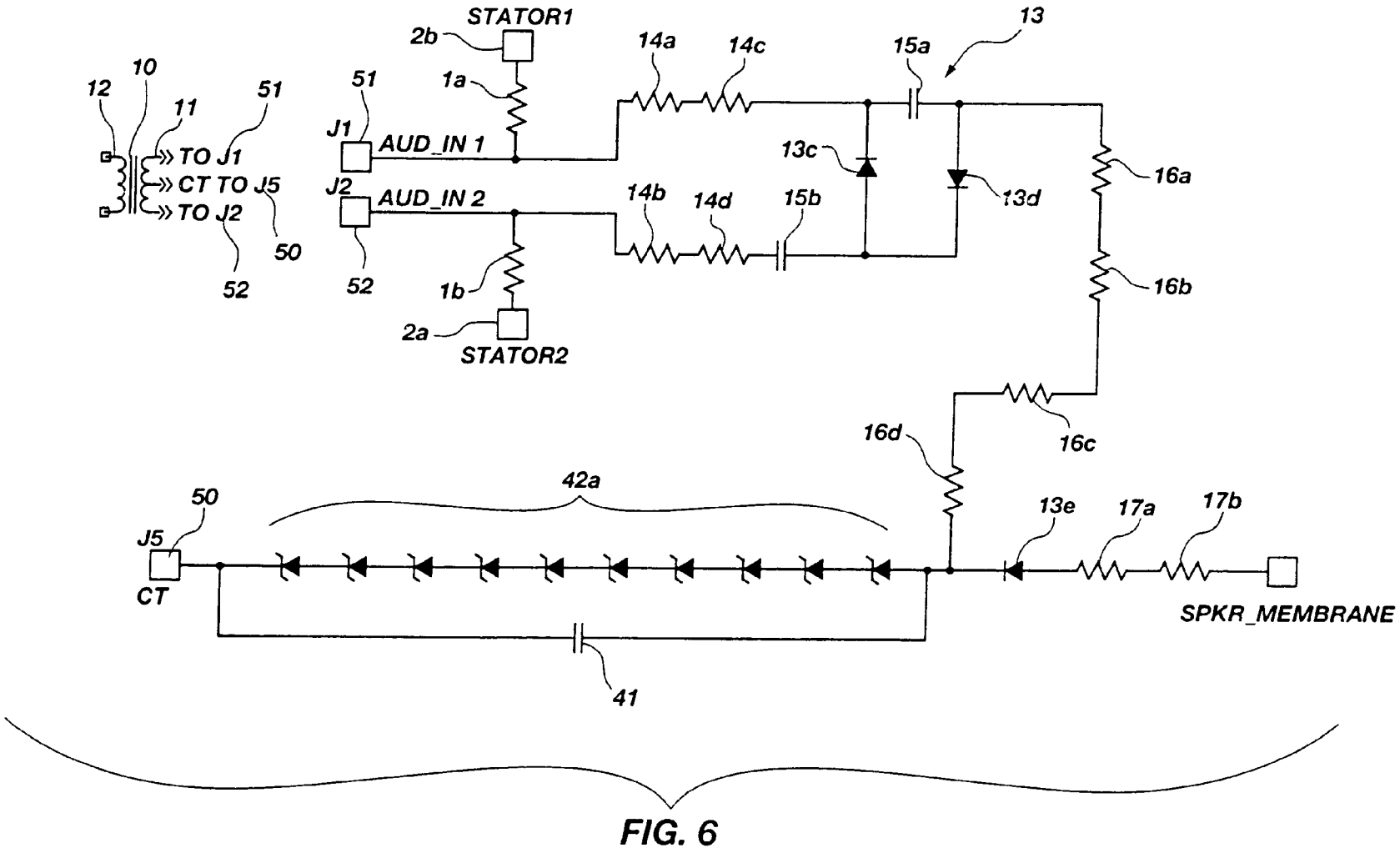
FIG. 6 shows a schematic diagram of one implementation of a signal derived, self bias power supply.

FIG. 6 represents a preferred embodiment of the invention and describes a more complex embodiment that is used to implement the simpler forms of the other figures. Referring now to FIG. 6, the audio signal from a power amplifier is first applied to the input 12 of a step-up or matching transformer 10. The secondary winding 11 of the transformer 10 provides a high voltage and high impedance output, which drives the stators of the electrostatic speaker. Additionally, the secondary winding 11 of the transformer 10 has a center-tap connection 50.

The details of the circuit operation in FIG. 6 will now be described. The high voltage output of the transformer 10 drives the stators through the resistors 1*a* and 1*b* which provide high frequency equalization of the audio output. Additionally, the high voltage outputs of the transformer are applied to the voltage multiplier/rectifier circuit 13, consisting of diodes 13*c* and 13*d*, resistors 14*a*, 14*b*, 14*c*, 14*d*, capacitors 15*a* and 15*b*, followed by resistors 16*a*, 16*b*, 16*c*, 16*d*. The resistors (14*a*, 14*b*, 14*c*, 14*d*, 16*a*, 16*b*, 16*c*, 16*d*) limit the maximum loading on the transformer 10 during surges in the audio output level, which avoids any noticeable distortion of the output signal to the stators 2*a*, 2*b*. Capacitors 15*a* and 15*b* and the high voltage diodes 13*c* and 13*d* form a conventional voltage doubling circuit and provide a rapid build up of DC voltage on the diaphragm 3 with respect to the stators.

The DC voltage is applied through the diode 13*d*, and resistors 16*a* through 16*d* (in series) to a group of zener diodes 42*a* which are in series. These resistors and diodes clamp the DC level at the desired bias voltage and prevent any variation in the DC field as the level of the audio source fluctuates. For example, each of the 10 zener diodes would have a 200 volt rating which provides clamping at 2000 volts.

The capacitor 41 is also charged while biasing zener diodes 42*a* into their zener region. Although resistors 16*a*–16*c* are large enough to prevent any noticeable distortion of the audio, the combined R-C time constant is low enough to add only a negligible amount of delay to the charge time of capacitor 41. Resistors 17*a* and 17*b* provide a high degree of isolation (on the order of 10 s of megohms) between the self-generated high voltage and the diaphragm so that the diaphragm operates in a "constant charge" mode and only a very small current flow (microamperes) can occur between the diaphragm 30 and the stators 2*a* and 2*b* with their highly variable voltages.

In addition to what has been described, diode 13*e* provides reverse isolation so that the capacitor 41, across the fully biased zener diode string 42*a*, will not be drained during periods when the average voltage level falls and the rectified output presented to diode 13*e* is less than the voltage across capacitor 41.

The polarities used in the examples above have been arbitrarily chosen to produce a negative voltage on the diaphragm with respect to the stators. To change this to a positive voltage all of the diodes would be turned around.

In several cases, there are multiple resistors placed in series where it would seem that a single resistor could suffice. This occurs for 14*a*–14*d*, 16*a*–16*d*, and 17*a*–17*b*. The purpose of placing identical resistors in series is to increase the voltage capability of the small, low wattage, carbon film resistors used. Individually, these resistors are only rated at from 300 to 500 volts (RMS). By creating resistor groups in series, the voltage rating of each group is increased proportionately to the number of resistors used. For example, if the peak voltage out of diode 13*e* can exceed 3000 volts and the combined clamping voltage of the zener diodes 42*a* is 2000 volts, using the resistors in series is appropriate. These implementation details are necessary for the circuit to operate within the prescribed tolerances, but the specific component values described are not necessary for the simplified embodiments of the invention to work.

As mentioned, a drawback of using electrostatic speakers which require a bias on the diaphragm is that the bias charge must first build up before the electrostatic speaker can operate. If the program signal is sent to the electrostatic speaker before the speaker is charged, then the program will not be heard at its proper volume. It is advantageous to "pre-charge" a signal bias supply so that it is already at an optimum voltage before the program material to be reproduced is supplied to the electrostatic loudspeaker. The present invention provides a more effective startup for the electrostatic speakers by using greater multiplication stages in the voltage multiplier circuit. The bias supply also uses a separate charging signal delivered from the associated active electronics to provide a charge on startup. Of course, the separate charging signal could also charge periodically or on a steady basis. If the pre-charge signal is sent periodically, this helps charge the diaphragm when it is idle for a period of time. The diaphragm might be idle between program segments, while the program signal has been turned off and the system remains on, or during a period of quiet in the program signal. For example, pre-recorded music will normally have several seconds of quiet between each selection which may allow the diaphragm voltage to fall. Similarly, most music players have a pause button which can pause the music and may allow the diaphragm to discharge.

Alternatively, the charging signal can be applied when the voltage on the diaphragm falls below a pre-determined level. An additional feedback circuit is required in this configuration to test the voltage level of the diaphragm and to determine when the charging signal should be sent. Typically the voltage level only falls below a pre-determined level when no signal is present but it is possible that the diaphragm voltage could decrease if the signal was very low or relatively weak.

The pre-charge signal can be derived from the associated active electronics, such as a power amplifier or pre-amplifier electronics. A pre-charge signal can be audible such as that generated from the turn-on thump of a power amplifier or it can be inaudibly derived from a signal that operates outside of the audible range of the electrostatic speaker, such as an ultrasonic or subsonic signal.

An ultrasonic charging signal can be generated from a simple sinusoidal oscillator, operating in the 25 to 30 KHz frequency range. This signal could even be input into the main amplifier whose output is already coupled into the speaker matching transformer. This is particularly suitable for a startup charge.

In some cases, a separate amplifier oscillator may be used to generate the ultrasonic signal and provide an isolated power source in series with the main amplifier output to the step-up transformer. Alternatively, a subsonic signal can be generated and used to bias the diaphragm. The use of a subsonic signal is defined as a signal of low enough frequency that the electrostatic speakers will not reproduce it or the signal is below human audibility. Using a subsonic signal is desirable because it is a charging signal which cannot be heard by humans and it avoids the thump associated with amplifier power up.

In most cases, (such as using a sub-harmonic charging frequency) it would be preferable to use the main amplifier to boost the signal to the speaker matching transformer, and to the level needed to develop the operating bias for the electrostatic speakers.

A pre-charging signal can also be used with a parametric loudspeaker which uses an electrostatic transducer. In this configuration, the ultrasonic charging signal source can be a signal from the modulator electronics. This type of charging signal may also be used with the self bias supply of the current invention and the transducer for the parametric loudspeaker.

Figure 7:
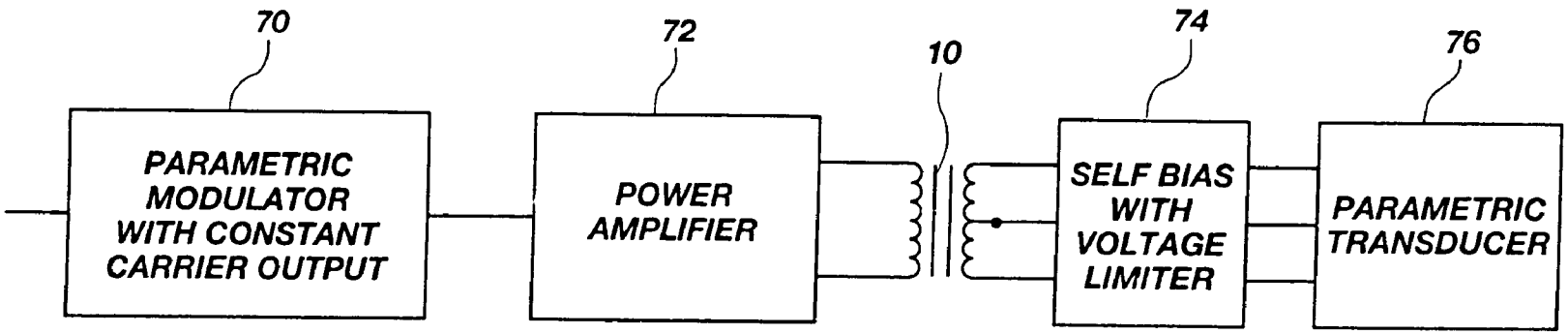
FIG. 7 shows a block diagram of the signal derived self bias supply connected to a parametric loudspeaker.

FIG. 7 illustrates a block diagram of the invention when used as part of a parametric loudspeaker system. The parametric modulator 70 produces a constant carrier frequency output, usually in the range of 30 kHz to 60 kHz which is well above the range of human hearing. This constant carrier output is independent of the program material being played through the system. As the carrier output flows through the power amplifier 72 and transformer 10 to the self bias circuit 74, the bias supply is charged prior to the delivery of program material such that the parametric transducer 76 is pre-biased for operation and optimized to play program material when the program signal is actually applied.

Figure 8:
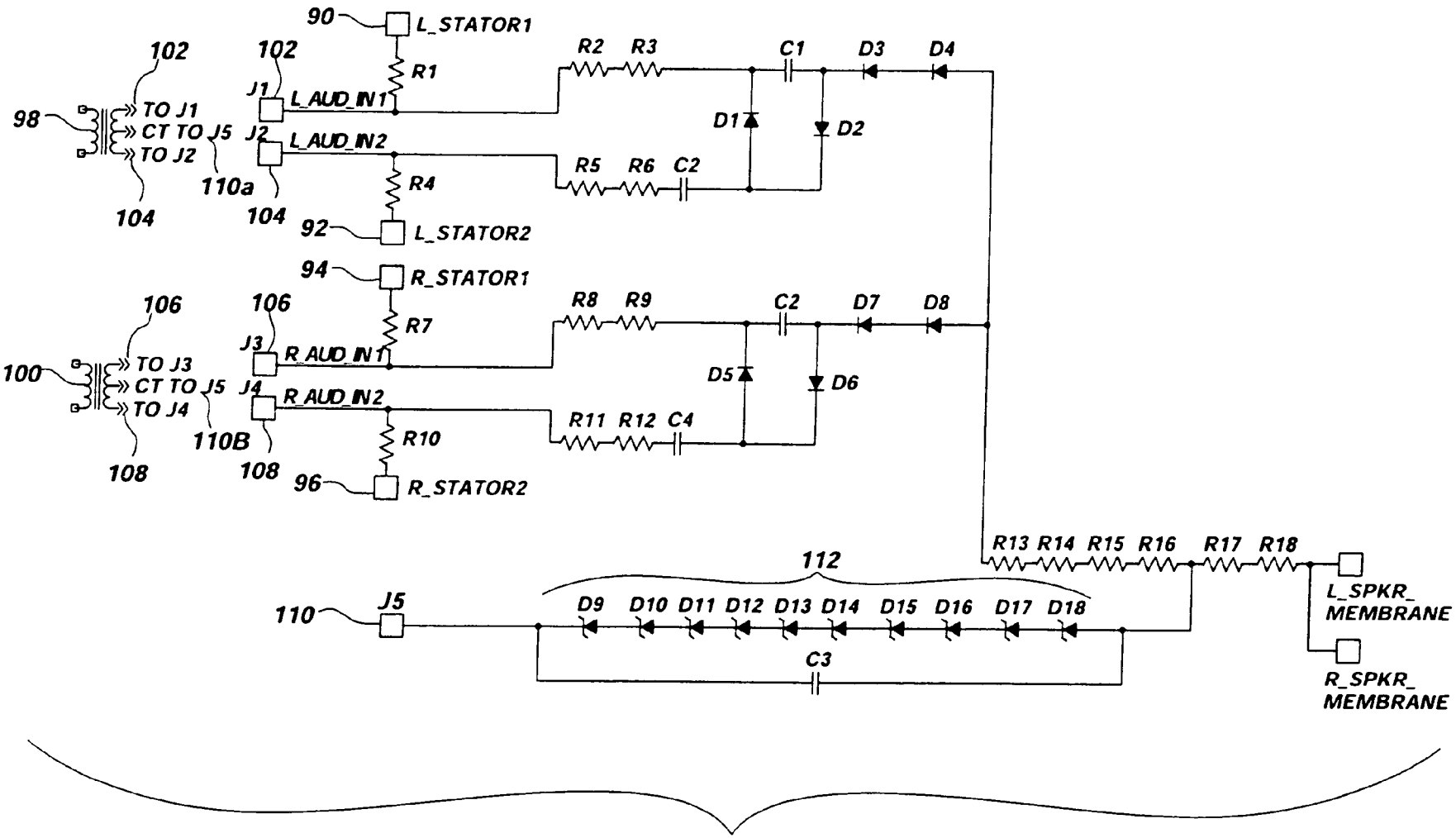
FIG. 8 shows a schematic diagram of a signal derived self bias supply with two transformers connected to two electrostatic speakers.

Referring now to FIG. 8, another embodiment of this invention uses an electrostatic speaker system with two or more transformers. In this configuration, each speaker has its own power transformer to power the stators. A separate self bias for the speaker diaphragm is then center tapped off of the transformer. Each speaker may be connected to a separate program signal or it may only carry the high and low frequencies for a certain signal.

Despite the straight forward configuration described, using a transformer for each speaker presents some problems. The major problem is that each speaker will have a different actual voltage bias on the speaker diaphragm. This bias difference is due to variations in materials and construction. So when the program signal is reproduced, one of the speakers may have a higher volume than the other or the stereo effects may be distorted as a result of the different diaphragm voltages.

The preferred embodiment of self biasing using more than one transformer is to bias all the diaphragms from a common voltage source. FIG. 8 shows a pair of stators, 90 and 92, for the first electrostatic speaker. A second set of stators for the second speaker are shown as 94 and 96. Each of the transformers 98 and 100, receive AC inputs to a primary winding, and the secondary windings create a stepped up voltage for the electrostatic speakers. It is important to note that each stator 90, 92, 94, and 96 is powered from transformer taps 102, 104, 106, and 108 respectively. Each of the diaphragms is connected to a single rectifier and voltage regulator 112 which is connected to the center taps 110*a* and 110*b* from both of the transformers 98 and 100. This may not be practical or cost effective in some systems from a spatial point of view, if the speakers are physically distant. Nevertheless, it is preferable to bias all the speaker diaphragms in a multiple speaker system from the same regulated voltage supply.

Figure 9:
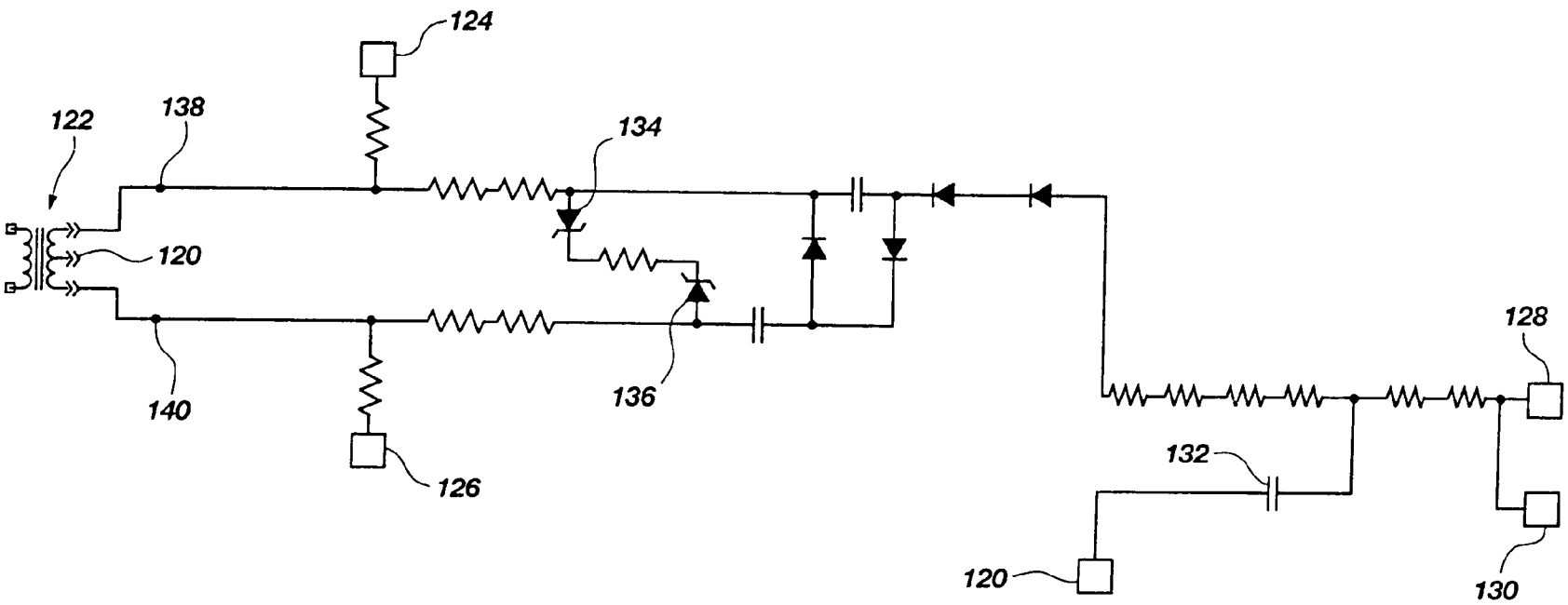
FIG. 9 shows a schematic of a self bias supply where the zener diodes are located near the secondary winding taps.

FIG. 9 shows a schematic of a self bias supply where the zener diodes are located near the secondary winding taps. Two stators 124 and 126 are powered from the high voltage taps 138 and 140 of the secondary winding. The center tap or bias return 120 is connected to two speaker membranes 128 and 130 and includes a capacitor 132 to aid in voltage regulation. Two zener diodes 134 and 136 are electrically located near the high voltage bias taps 138 and 140, and limit the voltage from the secondary windings of the transformer. It should be realized that although only two zener diodes are shown, each diode actually represents approximately 10 or more 200 volt diodes which regulate the 2000–3000 volt output of the step up transformer 122.

Figure 10:
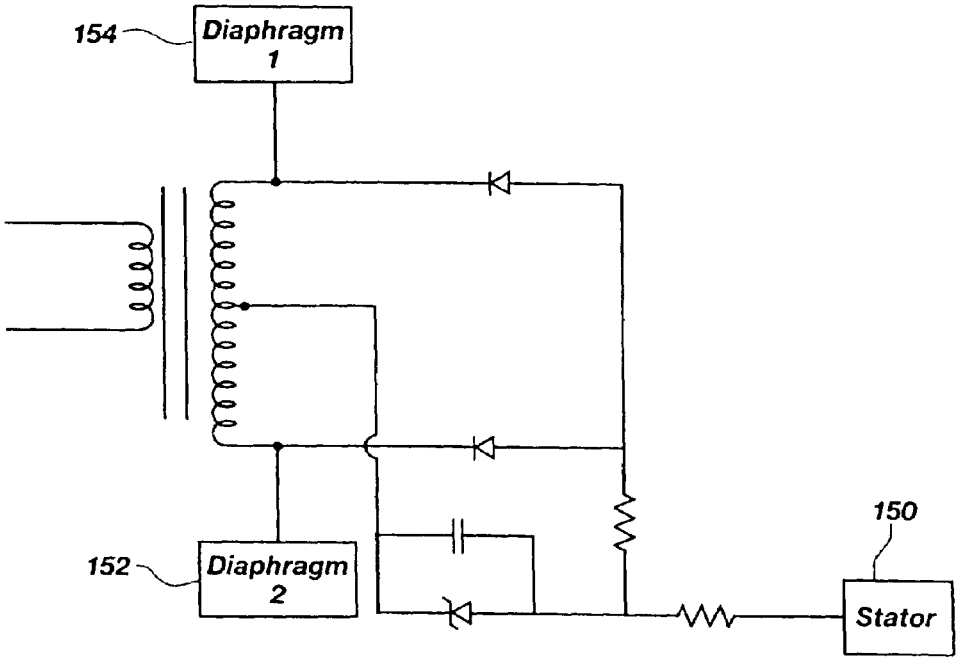
FIG. 10 shows a self bias supply with the bias connected to a single stator and the signal connected to two separate diaphragms.

FIG. 10 shows a self bias supply with the bias connected to a single stator 150 and the high voltage signal connected to two separate diaphragms 152 and 154. The electrical components of this schematic diagram are explained in further detail in FIG. 4A above. The physical construction of the speaker shown in the schematic diagram of FIG. 10 is a single stator with a diaphragm on either side of the stator. This physical arrangement is shown and described in patent applications Ser. No. 09/207,314 by Croft, et al and U.S. patent application Ser. No. 09/375,145 by Croft, et al. which are herein incorporated by reference.

Figure 11:
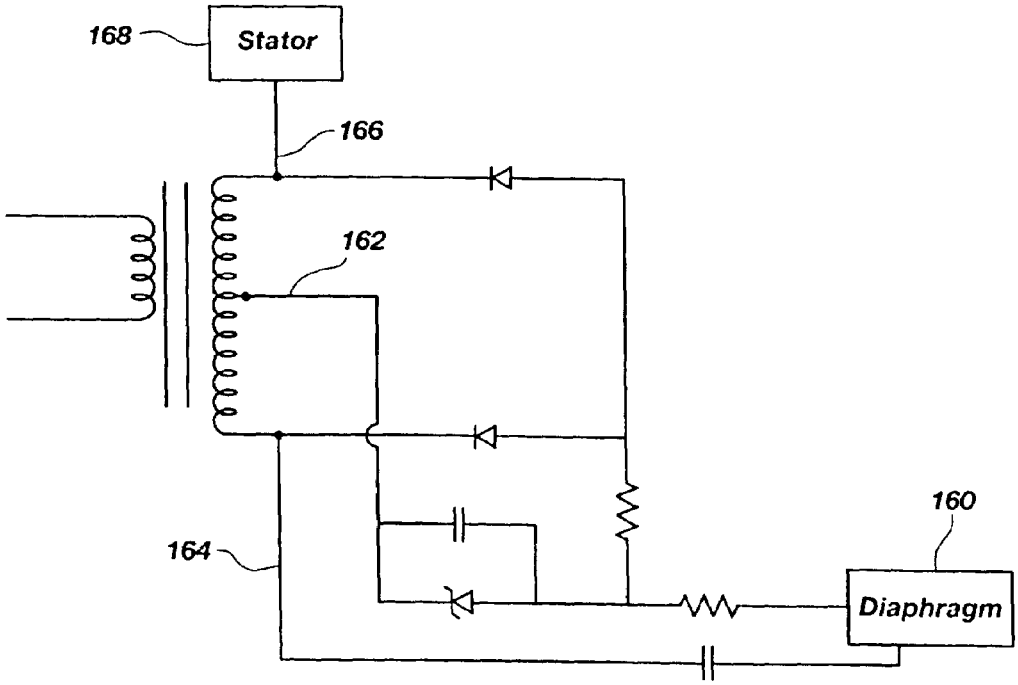
FIG. 11 shows a bias supply with one tap from the high voltage secondary winding coupled to the diaphragm, the bias return tap connected to the diaphragm, and one tap from the high voltage winding connected to the stator.

FIG. 11 shows the bias return tap 162 (or center tap) and one tap from the high voltage signal winding 164 coupled to the diaphragm 160. Another tap from the high voltage secondary winding 166 is connected to the stator 168. This arrangement drives a single stator 168 and single self biased diaphragm 160. It should also be apparent from this disclosure that the stator and diaphragm in FIG. 11 could be switched.

It is to be understood that the above-described arrangements are only illustrative of certain embodiments of the present invention. Numerous modifications and alternative arrangements may be devised by those skilled in the art without departing from the spirit and scope of the present invention. The appended claims are intended to cover such modifications and arrangements.

What is claimed is:

1. An audio signal derived bias supply for use with an electrostatic loudspeaker having at least two stators and a diaphragm, comprising:

(a) at least one transformer, adapted to receive an audio signal, and having a primary winding, and primary connection taps;

(b) a secondary winding, magnetically coupled to the primary winding, having at least three secondary connection taps including a center tap, wherein the at least two stators are connected to at least two secondary connection taps that are main audio output taps;

(c) a bias circuit, connected to at least three secondary connection taps, having a bias return to the center tap, wherein the bias circuit biases the diaphragm, the bias circuit further comprising:

(i) at least one rectification unit with at least two rectifiers; and (ii) at least one voltage limiter, coupled to the rectifier.

2. The bias supply as in claim 1 wherein the at least one rectification unit includes at least two rectifiers and at least one capacitor to form a voltage multiplier which is connected to the at least one secondary winding.

3. The bias supply as in claim 2 wherein the at least one voltage limiting unit consists of a shunt regulator.

4. The bias supply as in claim 3 wherein the shunt regulator consists of at least one zener diode and at least one capacitor.

5. The bias supply of claim 4 wherein the at least one capacitor is in parallel with the at least one zener diode.

6. The bias supply as in claim 4 wherein the secondary winding further comprises at least two additional secondary winding taps that provide a voltage greater than the secondary signal voltage that appears at the secondary windings that are the main audio taps, wherein the bias circuit is connected to the at least two additional secondary winding taps.

7. The bias supply as in claim 1 wherein the bias circuit is adapted to receive a power signal from center taps of each of two or more transformers, and configured to supply a bias voltage to more than one electrostatic loudspeaker diaphragm.

8. The bias supply as in claim 7 wherein the more than one transformer receives audio signals from at least two audio channels.

9. The bias supply as in claim 1 wherein a resistance is connected between the rectification unit and the voltage limiting unit.

10. The bias supply as in claim 1 wherein a resistance is connected between the rectification unit and the secondary winding.

11. The bias supply as in claim 1 wherein the at least one rectification unit further comprises a voltage multiplier having at least two rectifiers and two capacitors, wherein the at least one voltage limiting unit is connected to the voltage multiplier through at least one resistor.

12. The bias supply as in claim 1 wherein the voltage limiting unit further comprises:

(1) a plurality of zener diodes in series;

(2) a capacitance connected in parallel with the plurality of zener diodes; and (3) an electrostatic membrane coupled to the capacitance and plurality of zener diodes.

13. The bias supply as in claim 1 wherein the voltage limiter is connected to the electrostatic diaphragm through a resistor.

14. An audio signal derived bias supply for use with an electrostatic loudspeaker having at least two stators and a diaphragm, comprising:

(a) at least one transformer, adapted to receive an audio signal, and having a primary winding and primary connection taps;

(b) a secondary winding, magnetically coupled to the primary winding, having at least two secondary connection taps, wherein the at least two stators are connected to the at least two secondary connection taps;

(c) a bias circuit, connected to at least one secondary connection tap, having a bias return, wherein the bias circuit biases the diaphragm, the bias circuit further comprising:

(i) at least one rectification unit; and (ii) at least one alternating current voltage limiting unit, coupled to at least two secondary connection taps.

15. The bias supply as in claim 14 wherein the at least one rectification unit includes at least one diode and at least one capacitor to form a voltage multiplier which is connected to the at least one secondary winding after the alternating current voltage limiting unit.

16. A method for charging a diaphragm of an electrostatic loudspeaker, comprising the steps of:

(a) receiving an audio signal into a primary winding of a transformer;

(b) stepping up a voltage of the audio signal to a higher voltage through a secondary transformer winding which has at least two secondary connection taps and a center tap;

(c) rectifying the audio signal voltage from the at least two secondary connection taps to produce a rectified voltage;

(d) applying a voltage limiter, coupled to the center tap, to the rectified voltage to produce a regulated voltage; and (e) supplying the regulated voltage from the at least two secondary connection taps to at least one diaphragm of the electrostatic speaker to power the at least one diaphragm and charge the diaphragm faster by using the at least two secondary connection taps.

17. The method as in claim 16 wherein step (c) further comprises the step of rectifying the audio signal voltage using at least one rectifier and at least one capacitor to form a voltage multiplier which is connected to the at least one secondary winding.

18. The method as in claim 16 wherein step (c) further comprises the step of applying a voltage limiting unit using a shunt regulator.

19. The method as in claim 16 wherein step (c) further comprises the step of applying a voltage limiting unit with at least one zener diode and at least one capacitor.

20. The method as in claim 16 wherein step (c) further comprises the step of applying a voltage limiting unit with at least one zener diode and at least one capacitor in parallel.

21. The method as in claim 16 wherein step (c) further comprises the step of applying a resistance before the voltage limiter.

22. The method as in claim 17 wherein step (b) further comprises the step of applying a resistance before rectification unit and the one secondary winding.

23. An audio signal derived bias supply for use with an electrostatic loudspeaker having at least one stator and at least two diaphragms, comprising:

(a) at least one transformer, adapted to receive an audio signal, and having a primary winding, and primary connection taps;

(b) a secondary winding, magnetically coupled to the primary winding, having at least two secondary connection taps and a bias return, wherein the at least two diaphragms are connected to the at least two secondary connection tap;

(c) a bias circuit, connected to the at least two secondary connection taps and the bias return, configured to bias the at least one stator, and the bias circuit further comprises:

(i) at least one rectifier; and (ii) at least one voltage limiter, coupled to the rectifier.

24. A power supply for biasing a diaphragm in an electrostatic loudspeaker system, comprising:

(a) a power supply;

(b) an amplifier, coupled to the power supply, and adapted to receive an audio signal;

(c) a transformer, connected to the amplifier to receive the audio signal, the transformer having primary and secondary windings;

(d) a bias supply, coupled to the transformer to receive power from the secondary windings of the transformer, and to output a bias voltage to the diaphragm;

(e) at least one stator to which the audio signal is applied; and (f) wherein the amplifier is configured to supply a charging signal separate from the audio signal, and the charging signal can be applied to energize the bias supply.

25. The electrostatic loudspeaker system as in claim 24 wherein the charging signal can be activated when no program signal is present.

* * * * *